US011807481B2

(12) United States Patent
Burt

(10) Patent No.: US 11,807,481 B2
(45) Date of Patent: Nov. 7, 2023

(54) SINGLE TAPE ESCROW MODULE

(71) Applicant: NCR Corporation, Atlanta, GA (US)

(72) Inventor: Maximilian Barclay Burt, Aberdeen (GB)

(73) Assignee: NCR Corporation, Atlanta, GA (US)

( * ) Notice: Subject to any disclaimer, the term of this patent is extended or adjusted under 35 U.S.C. 154(b) by 442 days.

(21) Appl. No.: 17/004,151

(22) Filed: Aug. 27, 2020

(65) Prior Publication Data

US 2022/0063948 A1 Mar. 3, 2022

(51) Int. Cl.
*B65H 29/12* (2006.01)

(52) U.S. Cl.
CPC ..... *B65H 29/12* (2013.01); *B65H 2515/31* (2013.01); *B65H 2701/1912* (2013.01)

(58) Field of Classification Search
CPC .... B65H 290/12; B65H 29/006; B65H 29/51; B65H 29/12
See application file for complete search history.

(56) References Cited

U.S. PATENT DOCUMENTS 4,530,694 A * 7/1985 Kobler ..... B65H 29/00 493/425
5,609,335 A * 3/1997 Parker ..... B65H 31/06 271/200
5,735,516 A * 4/1998 Gerlier ..... G07F 19/203 414/789.9
6,296,242 B1 * 10/2001 Saltsov ..... G07D 11/12 271/3.21
8,162,308 B2 * 4/2012 Kobayashi ..... B65H 7/18 242/421
9,670,023 B2 * 6/2017 Liang ..... B65H 5/28
10,618,764 B2 * 4/2020 Shimamura ..... B65H 7/06
11,472,657 B2 * 10/2022 Izawa ..... B65H 29/51
2009/0236204 A1 * 9/2009 Bertotto ..... B29D 29/06 156/137
2022/0204300 A1 * 6/2022 Tachibana ..... G07D 11/12

FOREIGN PATENT DOCUMENTS

JP 3534966 B2 * 6/2004 ..... B65H 29/006

* cited by examiner

*Primary Examiner* — Patrick H MacKey
(74) *Attorney, Agent, or Firm* — Schwegman Lundberg & Woessner, P.A.

(57) ABSTRACT

Disclosed is an escrow module. The escrow module may include a drum, a first belt and a tape. The drum may have a first end, a second end, and an intermediate portion. The first belt may partially encircle the drum. The tape may have a first end attached to the drum and a second end attached to a spool. Upon rotation of the drum in a first direction, a first side of a media object may contact the tape and a second side of the media object may contact the first belt.

20 Claims, 7 Drawing Sheets

SINGLE TAPE ESCROW MODULE

FIELD OF THE DISCLOSURE

The present subject matter relates to self-service terminals and, more particularly, to escrow modules. More specifically, the present disclosure relates to escrow modules having a single tape.

BACKGROUND

Today's self-service terminals can do more than dispense media, such as banknotes. They can both receive and dispense media. While receiving and dispensing media, self-service terminals may use an escrow module to temporarily store and/or sort media.

SUMMARY

Disclosed is an escrow module. The escrow module may include a drum, a first belt and a tape. The drum may have a first end, a second end, and an intermediate portion. The first belt may partially encircle the drum. The tape may have a first end attached to the drum and a second end attached to a spool. Upon rotation of the drum in a first direction, a first side of a media object may contact the tape and a second side of the media object may contact the first belt.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Corresponding reference characters indicate corresponding parts throughout the several views. The exemplifications set out herein illustrate example embodiments of the invention, and such exemplifications are not to be construed as limiting the scope of the invention any manner.

DETAILED DESCRIPTION

Typical escrow designs have two or more tape spools to capture media onto an escrow drum. The tapes are notoriously fragile and often serve as a common source of escrow faults. Media, such as banknotes or cheques, that have jammed inside the escrow tape on the drum also are notoriously difficult to drive off the escrow drum. As a result, media jammed inside the escrow unit usually requires replacement of the escrow unit or a complete disassembly of the escrow unit to remove the jammed media. Repairs of this nature are expensive and can result in significant downtime for self-service terminals or other media handling devices.

As disclosed herein, an escrow drum may use a single spool of tape and one tape layer to wrap media around a drum instead of multiple spools of tape. The result may be reduced complexity, cost, and part numbers. The escrow units may also include a belt that can act as an outer layer. The belt may also serve as a drive belt to facilitate improved media drive onto and off the escrow drum.

The escrows disclosed herein can utilize a single spool of tape. The single spool of tape can wrap itself around a drum of the escrow to escrow media. For example, media can be driven onto an outer surface of the tape by a belt drive. As the drum rotates, the media can be driven around the circumference of the drum with a layer of tape between the media and the drum surface. As the drum rotates the media contacts the inside surface of the tape at the end of one revolution of the drum. This process continues until all media in a transaction have wrapped themselves around the drum with only a single layer of tape separating the media per revolution of the drum.

To remove the media, the drum is reversed and the media is driven off the drum. By using a belt drive to wrap around the outer layer of the escrow drum, media can more readily be driven off the drum due to the high contact forces and frictional forces.

As disclosed herein, the belt and drum can be driven by a single motor. The belt and drum can also be driven by multiple motors. The tape can be driven via a bi-directional clutch which engages and disengages to maintain tension in the tape.

The above discussion is intended to provide an overview of subject matter of the present patent application. It is not intended to provide an exclusive or exhaustive explanation of the invention. The description below is included to provide further information about the present patent application.

Figure 1:
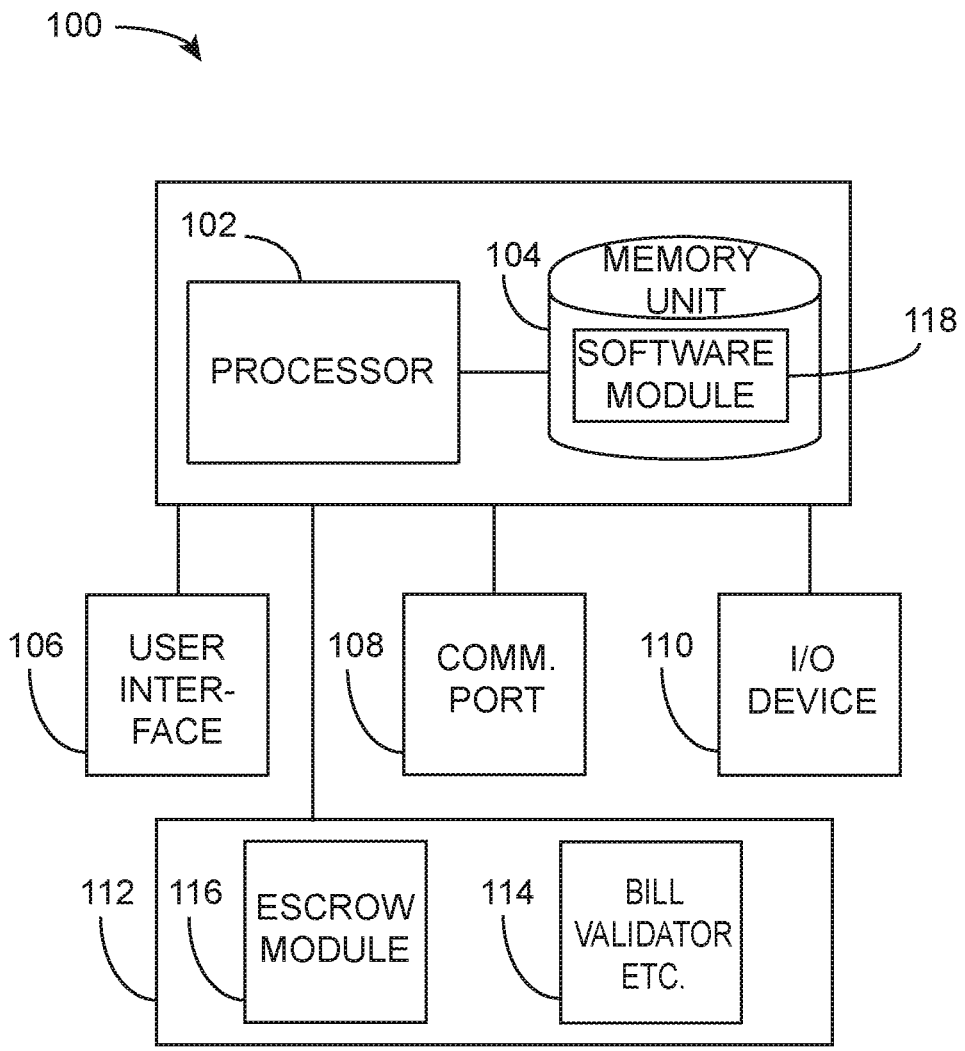
FIG. 1 shows an example schematic of a self-service terminal consistent with at least one example of this disclosure.

Turning now to the figures, FIG. 1 shows an example schematic of a self-service terminal 100 consistent with at least one example of this disclosure. Self-service terminal 100 can include a processor 102, a memory unit, 104, a user interface 106, a communications port 108, an input/output (I/O) interface 110, and a media handling unit 112. Media handling unit 112 may include a bill validator or other components 114 and an escrow module 116. Memory unit 104 can include a software module 118, Software module 118 may perform processes for controlling self-service terminal 100, For example, software module 118 can control escrow module 116 and bill validator or other components 114.

User interface 106 may include a keypad, a display (touchscreen or otherwise), etc. In addition, user interface 106 may include audio equipment such as speakers, a microphone, a headphone jack, etc. that may be used to allow users to interface with self-service terminal 100.

Communications port 108 may allow self-service terminal 100 to communicate with various information sources, such as, but not limited to, remote computing devices such as servers, bank computers, other point of sale devices, etc. As disclosed herein, communications port 108 may be wired or wireless. Non-limiting examples of communications port 108 include, Ethernet cards (wireless or wired), Bluetooth transmitters and receivers, near-field communications modules, serial port interfaces, etc.

I/O device 110 may allow self-service terminal 100 to receive and output information. Non-limiting examples of I/O device 110 include, a camera (still or video), a printer, a scanner, biometric readers, scales, etc. Bill validator and other components 114 can also be I/O devices and included as part of I/O device 100.

Figure 2:
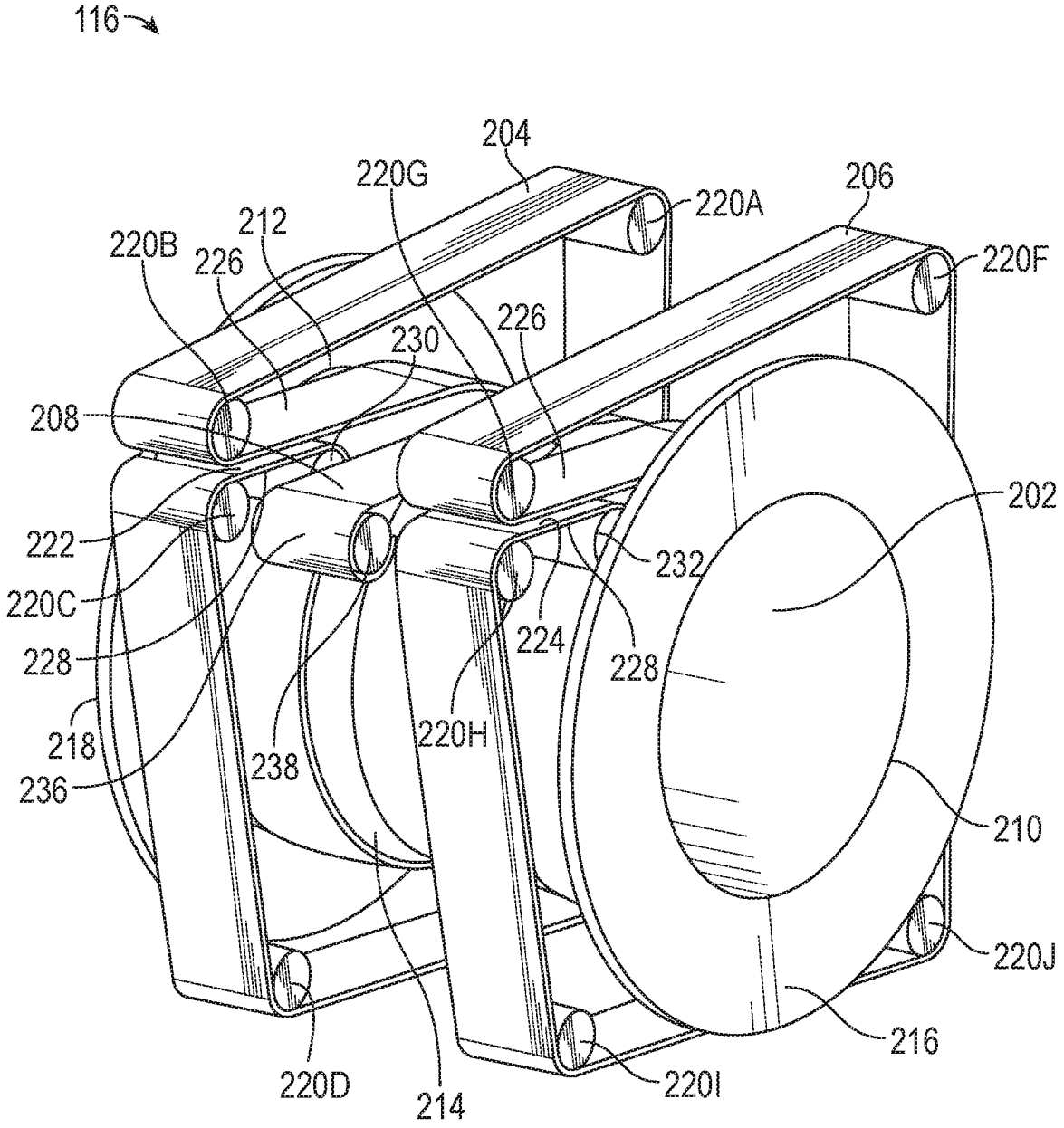
FIG. 2 shows an example of an escrow module consistent with at least one example of this disclosure.
Figure 3:
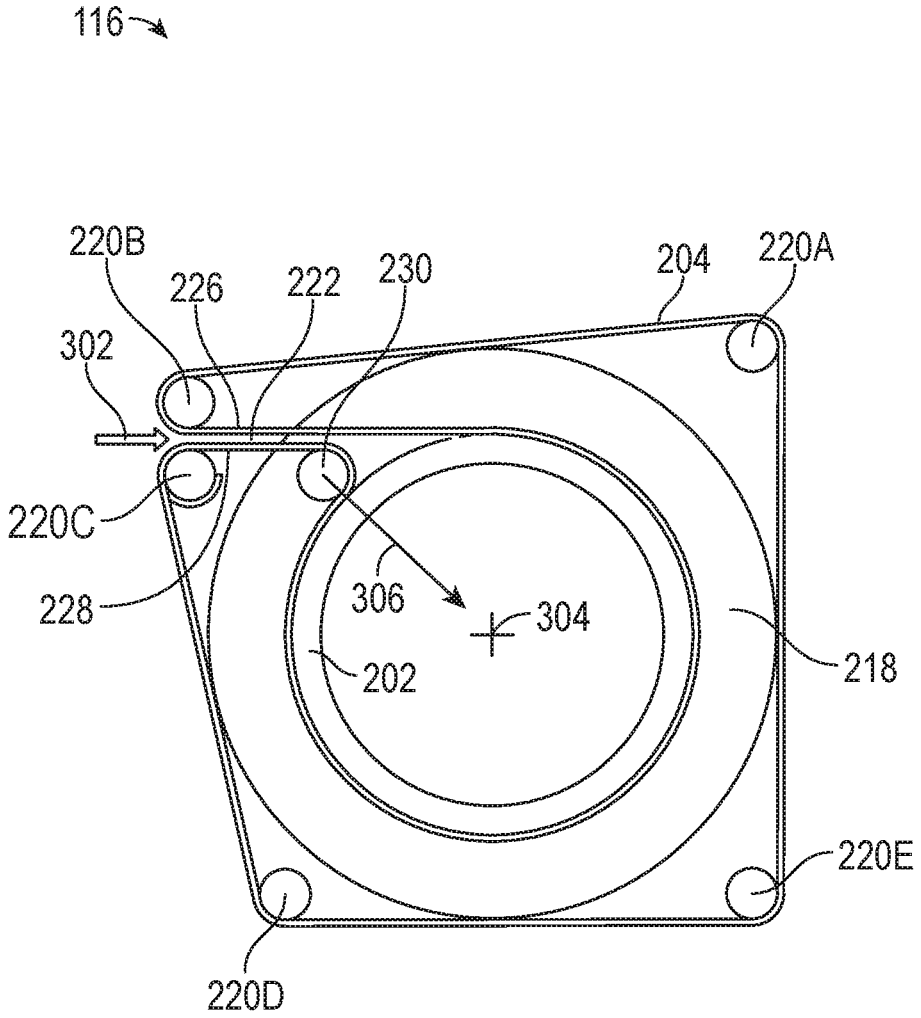
FIG. 3 shows an example cross-section of an escrow module consistent with at least one example of this disclosure.

FIG. 2 shows an example of escrow module 116 consistent with at least one example of this disclosure. Escrow module 116 can include a drum 202, a first belt 204, a second belt 206, and a tape 208. Drum 202 may include a first end 210, a second end 212, and an intermediate portion 214 located in between first end 210 and second end 212. Drum 202 may include a first flange 216 located proximate first end 210 and a second flange 218 located proximate second end 213. As shown in FIG. 3, second belt 204 can partially encircle drum 202. First belt 204 can partially encircle drum 202 in the same or similar manner. First belt 204 and second belt 206 are continuous belts.

Figure 4:
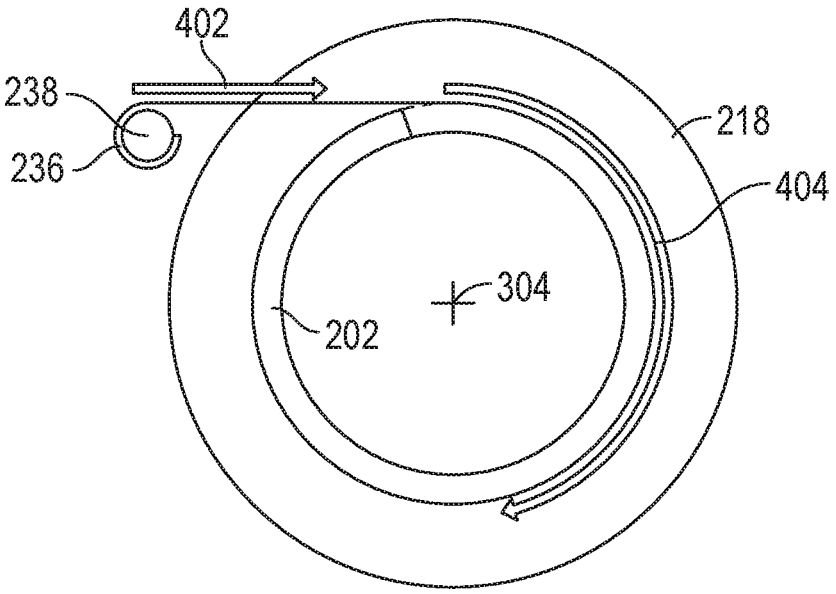
FIG. 4 shows an example cross-section of an escrow module consistent with at least one example of this disclosure.

While FIG. 2 shows two belts, example embodiments can include a single belt, such as first belt 204. For example, first belt 204 can be located proximate the center of intermediate portion 214. As a result, tape 208 can pass in between a first passage 222 formed by first belt 204 as shown in FIGS. 3 and 4. Thus, upon an initial rotation of drum 202, a first side of a media object can contact tape 208 and a second side of the media object can contact first belt 204 to be transported to drum 202. After completing the initial revolution, the second side of the media object can contact tape 208 as disclosed herein to be secured to drum 202.

Escrow module 200 may also include a plurality of pullies 220 (labeled individually as 220A, 220B, etc.). Pullies 220 can be used to position first belt 204 and second belt 206. For example, as shown in FIGS. 2 and 3, first belt 204 and second belt 206 can be positioned around drum 202 so as to form a first passage 222 and a second passage 224. As disclosed herein, media can pass in between first passage 222 and second passage 224 to be transported to and from drum 202. Also, and during operation, a first portion 226 and a second portion 228 of first belt 204 and second belt 206 can contact one another. In other words, the distance between first portion 226 and second portion 228 is exaggerated in the figures. The contact between first portion 226 and second portion 228 may cause first belt 204 and second belt 206 to grip media and transport it as indicated by arrow 302.

Escrow module 200 may also include a first tensioner 230 and a second tensioner 232. Tensioners 230 and 232 may be fixed or may be movable. For example, tensioners 230 and 232 can be connected to springs or other biasing members that can be connected to a frame or other component of escrow module 200 or self-service terminal 100. Tensioners 230 and 232 can be biased towards as center 304 of drum 202 as indicated by arrow 306. As disclosed herein, as the number of media objects increases, tensioners 230 and 232 can travel away from center 304 to allow first and second belts 204 and 206 to accommodate the increased number of media objects.

The tension on belts 204 and 206 can create friction between belts 204 and 206 and drum 202. The friction can allow drum 202 to cause belts 204 and 206 to move as drum 202 rotates. For example, a motor, which can be one of other components 114, can be used to rotate drum 202 and in turn, cause belts 204 and 206 to move.

Still consistent with examples disclosed herein, the friction between belts 204 and 206 and drum 202 can allow belts 204 and 206 to cause drum 202 to rotate. For example, a motor can drive any one of pullies 220, which in turn can cause rotation of drum 202.

Figure 5:
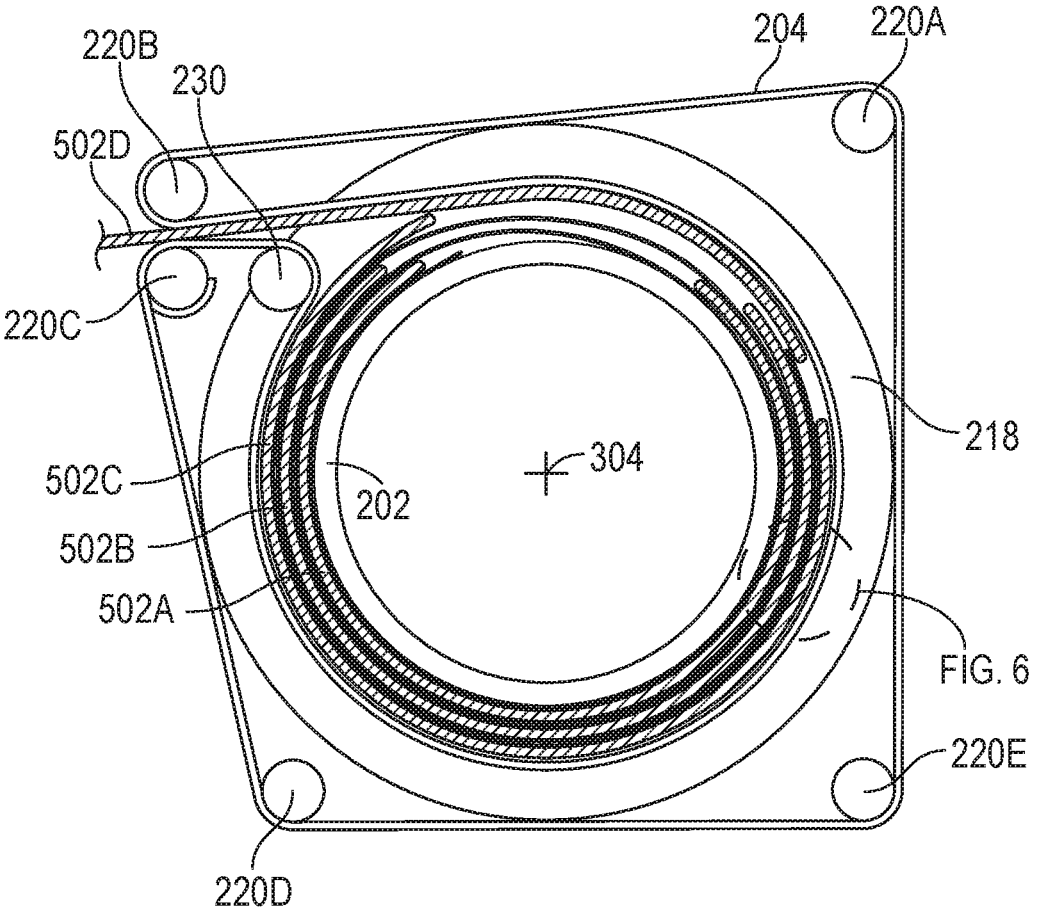
FIG. 5 shows an example cross-section of an escrow module consistent with at least one example of this disclosure.

Escrow module 116 can include spool 236, which can be attached to a clutch 238. Clutch 238 can provide tension on spool 236. Thus, as drum 202 rotates to accept media, clutch 238 can allow tape 208 to dispense from spool 236 while maintaining appropriate back tension on tape 208, which can also be attached to the intermediate portion of drum 202. Appropriate back tension includes adequate tension so that tape 208 maintains contact with drum 202 or any media that may be located in between tape 208 and drum 202. One skilled in the art will understand how clutch 238 can be mounted within escrow module 116 or self-service terminal 100, FIGS. 4 and 5 show cross-sectional views of escrow module 116 consistent with embodiments of this disclosure. As shown in FIG. 4, a media object, such as a banknote, can travel along tape 208 as indicated by arrow 402. Upon contacting drum 202, the media object, which can be resting on tape 208, can be held against drum 202 by first and second belts 204 and 206. The media object can travel around drum 202 as indicated by arrow 404.

Figure 6:
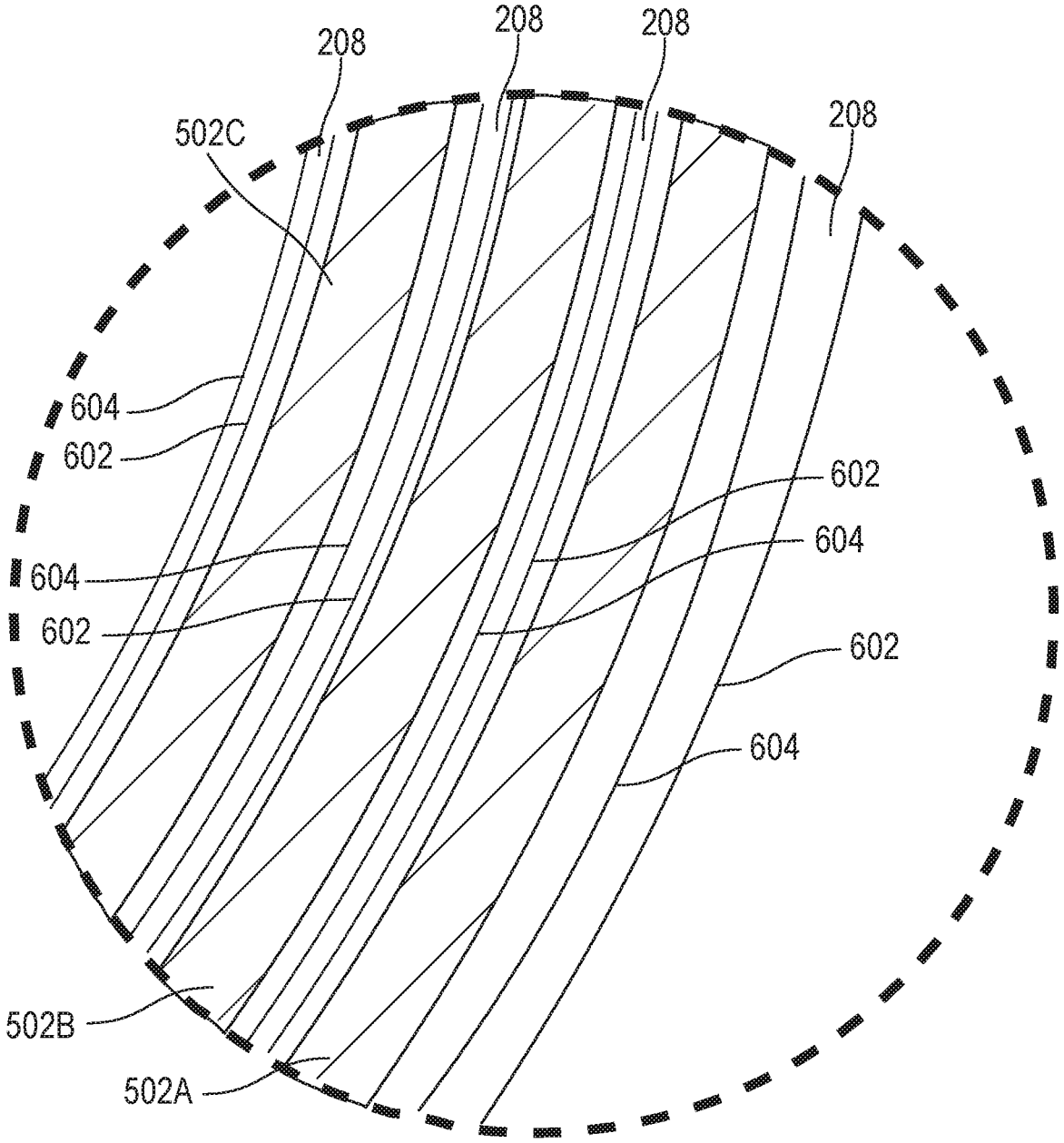
FIG. 6 shows a detail of FIG. 5 consistent with at least one example of this disclosure.

As shown in FIG. 5, each revolution of drum 202 can allow multiple media objects 502 (labeled individually as 502A, 502B, etc.) to be accepted by escrow module 116 and stored. As disclosed herein and shown in FIG. 6, as drum 202 rotates, media objects 502 can contact a first side 602 of tape 208 and a second side 604 of tape 208. The contact with first side 602 and second side 604 can cause media objects 502 to be held against drum 202 while providing a mechanism for separating each of media objects 502 from one another as the media objects 502 are temporarily stored on drum 202.

Figure 7:
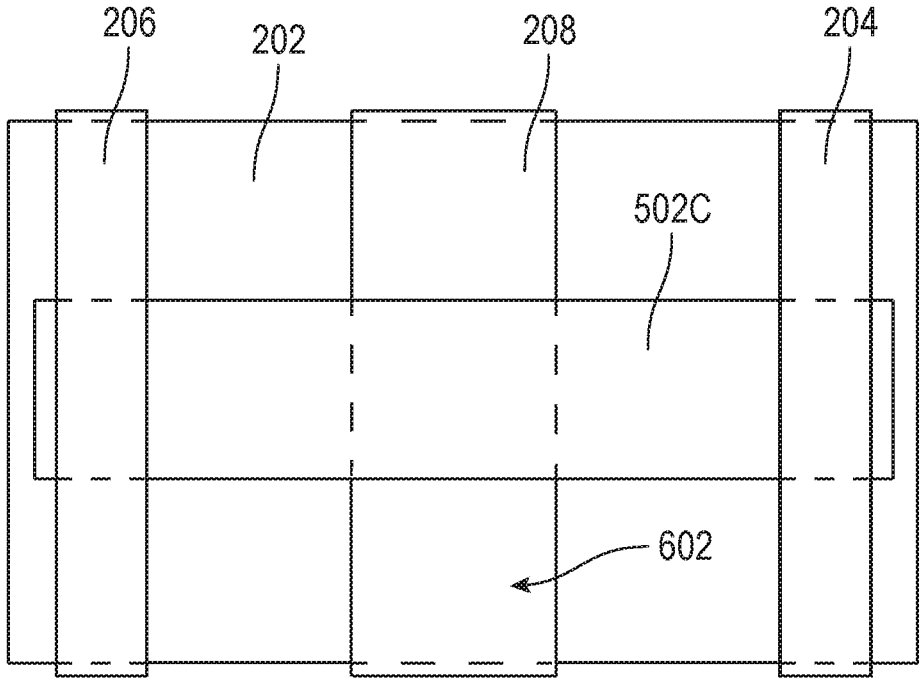
FIG. 7 shows a media object in contact with a drum, tape, and belts consistent with at least one example of this disclosure.

During an initial rotation around drum 202, media objects 502 contact first side 602 and are held against drum 202 by first and second belts 204 and 206 as shown in FIG. 7. As shown in FIG. 7, the ends of media objects, such as media object 502C, can be located in between first and second belts 204 and drum 202. Media object 502 can contact first side 602 of tape 208 as shown to form a weave type pattern.

To remove the media objects from escrow module 100, drum 202 can rotate in a second direction that is opposite the first direction. Upon rotation, tape 208 can transport the media objects from drum 202 in a direction that is opposite arrows 402 and 404.

EXAMPLES

The following, non-limiting examples, detail certain aspects of the present subject matter to solve the challenges and provide the benefits discussed herein, among others.

Example 1 is an escrow module comprising: a drum having a first end, a second end, and an intermediate portion; a first belt partially encircling the drum; and a tape having a first end attached to the drum, wherein upon rotation of the drum in a first direction, a first side of a media object contacts the tape and a second side of the media object contacts the first belt.

In Example 2, the subject matter of Example 1 optionally includes wherein a first side of the tape at least intermediately contacts a first side of the first belt.

In Example 3, the subject matter of any one or more of Examples 1-2 optionally include Wherein the drum comprises: a second belt partially encircling the second end of the drum; a first flange attached proximate the first end, the first belt located proximate the first flange; and a second flange attached proximate the second end, the second belt located proximate the second flange.

In Example 4, the subject matter of Example 3 optionally includes a motor operatively connected to at least one of the first belt and the second belt, wherein rotation of the motor causes the drum to rotate in the first direction.

In Example 5, the subject matter of any one or more of Examples 1-4 optionally include wherein the during the rotation of the drum the media object is held in between the tape and the first belt.

In Example 6, the subject matter of any one or more of Examples 1-5 optionally include wherein after a first rotation of the drum, the first side of the media object contacts a first side of the tape and a second side of the media object contacts a second side of the tape.

In Example 7, the subject matter of any one or more of Examples 1-6 optionally include wherein the tape has a second end attached to a spool.

In Example 8, the subject matter of Example 7 optionally includes a clutch attached to the spool.

In Example 9, the subject matter of any one or more of Examples 1-8 optionally include a tensioner located proximate the drum and arranged to maintain a tension on the first belt.

In Example 10, the subject matter of Example 9 optionally includes wherein the tensioner has a fixed position.

In Example 11, the subject matter of any one or more of Examples 9-10 optionally include wherein the tensioner is moveable.

Example 12 is an escrow module comprising: a drum having a first end, a second end, and an intermediate portion; a first belt at least partially encircling the first end of the drum: a second belt at least partially encircling the second end of the drum; and a tape having a first end attached to the drum in between the first and second belts, wherein the escrow module does not include a second tape, wherein upon rotation of the drum in a first direction, a first side of a media object contacts a first side of the tape and a second side of the media object contacts both the first and second belts, wherein after a first revolution of the drum, the second side of the media object contacts a second side of the tape.

In Example 13, the subject matter of Example 12 optionally includes wherein the during the rotation of the drum the media object is held in between the tape and the first and second belts.

In Example 14, the subject matter of any one or more of Examples 12-13 optionally include wherein after a first rotation of the drum, the first side of the media object contacts a first side of the tape and a second side of the media object contacts a second side of the tape.

In Example 15, the subject matter of any one or more of Examples 12-14 optionally include wherein the drum comprises: a first flange attached proximate the first end of the drum, the first belt located proximate the first flange; and a second flange attached proximate the second end of the drum, the second belt located proximate the second flange.

In Example 16, the subject matter of any one or more of Examples 12-15 optionally include a motor operatively connected to at least one of the first belt and the second belt, wherein rotation of the motor causes the drum to rotate in the first direction.

In Example 17, the subject matter of any one or more of Examples 12-16 optionally include a tensioner located proximate the drum and arranged to maintain a tension on at least one of the first belt and the second belt.

In Example 18, the subject matter of Example 17 optionally includes wherein the tensioner has a fixed position.

In Example 19, the subject matter of any one or more of Examples 17-18 optionally include wherein the tensioner is moveable.

In Example 20, the subject matter of any one or more of Examples 12-19 optionally include wherein the tape has a second end attached to a spool.

In Example 21, the subject mailer of Example 20 optionally includes a clutch attached to the spool.

Example 22 is a method for escrowing a media object, the method comprising: causing a drum to rotate in a first direction; translating the media object along a tape with a first side of the media object in contact with the tape; and rotating the media object around the drum such that a second side of the media object contacts a first belt that at least partially encircles the drum.

In Example 23, the subject matter of Example 22 optionally includes wherein rotating the media object around the drum further comprises causing the media object to be held in between the tape and the first belt.

In Example 24, the subject matter of any one or more of Examples 22-23 optionally include wherein rotating the media object around the drum further comprises causing the first side of the media object to contact a first side of the tape and a second side of the media object to contact a second side of the tape.

In Example 25, the subject matter of any one or more of Examples 22-24 optionally include removing the media object from the drum.

In Example 26, the subject matter of any one or more of Examples 22-25 optionally include adjusting a tension on the first belt.

Example 27 is a self-service terminal comprising: a motor; and at least one escrow module comprising: a spool, a drum having a first end, a second end, and an intermediate portion, a first belt partially encircling the first end of the drum, a second belt partially encircling the second end of the drum, and a tape having a first end attached to the intermediate portion of the drum in between the first and second belts and a second end attached to the spool, wherein the escrow module does not include a second tape, wherein upon rotation of the drum in a first direction, the tape wraps around the drum so as to contact a media object on a first side and a second side of the tape.

In Example 28, the subject matter of Example 27 optionally includes wherein the escrow module further comprises a tensioner located proximate the drum and arranged to maintain a tension on the belt.

Example 29 is self-service terminal of Example 27, wherein the tensioner is moveable.

Example 30 is self-service terminal of Example 27, wherein the escrow module further comprises a clutch attached to the spool.

In Example 31, the subject matter of any one or more of Examples 27-30 optionally include wherein the drum comprises: a first flange attached proximate the first end, the first belt located proximate the first flange; and a second flange attached proximate the second end, the second belt located proximate the second flange.

In Example 32, the apparatuses or method of any one or any combination of Examples 1-31 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. An escrow module comprising:

a drum having a first end, a second end, and an intermediate portion;

a first belt at least partially encircling the drum;

at least 4 pullies, wherein a first pully and a second pully are situated above a surface of the drum and a third and fourth pully situated below the surface of the drum, wherein the first belt wrapped around and outer surfaces of the first pully, the second pully; the third pully, and the fourth pully;

a motor to drive the at least 4 pullies and cause rotation of the drum; and a tape having a first end attached to the drum, wherein the drum adapted to rotate in a first direction;

wherein a first side of a media object adapted to contact the tape with the drum rotating in the first direction; and wherein a second side of the media object adapted to contact the first belt with the drum rotating in the first direction;

wherein the tape is a single spool of tape and the escrow module includes no other tapes or spools of tapes.

2. The escrow module of claim 1, further comprising a tensioner located proximate the drum and arranged to maintain a tension on the first belt.

3. The escrow module of claim 1, wherein a first side of the tape at least intermediately contacts a first side of the first belt.

4. The escrow module of claim 1, wherein the drum comprises:

a second belt partially encircling the second end of the drum;

a first flange attached proximate the first end, the first belt located proximate the first flange; and a second flange attached proximate the second end, the second belt located proximate the second flange.

5. The escrow module of claim 4, further comprising the motor operatively connected to the at least 4 pullies, wherein rotation of the motor causes the drum to rotate in the first direction.

6. The escrow module of claim 1, wherein the during the rotation of the drum the media object is held in between the tape and the first belt.

7. The escrow module of claim 1, wherein after a first rotation of the drum, the first side of the media object contacts a first side of the tape and a second side of the media object contacts a second side of the tape.

8. The escrow module of claim 1, wherein the tape has a second end attached to a spool.

9. An escrow module comprising:

a drum having a first end, a second end, and an intermediate portion;

a first belt at least partially encircling the first end of the drum;

a second belt at least partially encircling the second end of the drum;

a first set of 4 pullies with a first pair of the first set situated above a surface of the drum and a second pair of the first set situated below a surface of the drum, wherein the first belt wrapped around an outer surface of the first pair and the second pair of the first set;

a second set of 4 pullies with a first pair of the second set situated above a surface of the drum and a second pair of the second set situated below a surface of the drum, wherein the second belt wrapped around an outer surface of the first pair and the second pair of the second set;

a motor to drive the first set and the second set of 4 pullies causing rotation of the drum; and a tape having a first end, and a second end, the first end attached to the drum in between the first, wherein the escrow module does not include a second tape, wherein the drum is adapted to rotate in a first direction;

wherein a first side of a media object is adapted to contact a first side of the tape with the drum rotating in the first direction;

wherein a second side of the media object is adapted to contact both the first and second belts with the drum rotating in the first direction, wherein the second side of the media object is adapted to contact a second side of the tape after a first revolution of the drum wherein the tape is a single spool of tape and the escrow module includes no other tapes or spools of tapes.

10. The escrow module of claim 9, further comprising a tensioner located proximate the drum and arranged to maintain a tension on at least one of the first belt and the second belt.

11. The escrow module of claim 9, wherein the during the rotation of the drum the media object is held in between the tape and the first and second belts.

12. The escrow module of claim 9, wherein after a first rotation of the drum, the first side of the media object contacts a first side of the tape and a second side of the media object contacts a second side of the tape.

13. The escrow module of claim 9, wherein the tape has a second end attached to a spool.

14. The escrow module of claim 9, wherein the drum comprises:

a first flange attached proximate the first end of the drum, the first belt located proximate the first flange; and a second flange attached proximate the second end of the drum, the second belt located proximate the second flange.

15. The escrow module of claim 9, further comprising the motor operatively connected to the first set and the second set of 4 pullies, wherein rotation of the motor causes the drum to rotate in the first direction.

16. A method for escrowing a media object, the method comprising:

causing a drum to rotate in a first direction by activating a motor operatively connected to a first set of 4 pullies and a second set of 4 pullies causing the drum to rotate in the first direction, wherein a first pair of the first set situated above a surface of the drum and a second pair of the first set situated below the surface of the drum, a first pair of the second set situated above the surface of the drum and a second pair of the second set situated below the surface of the drum, wherein a first belt is wrapped around an outer surface of the first pair and the second pair of the first set and a second belt is wrapped around an outer surface of the first pair and the second pair of the second set;

translating the media object along a tape with a first side of the media object in contact with the tape, wherein the tape is a single spool of tape of an escrow module and the escrow module includes no other tapes or spools of tapes; and rotating the media object around the drum such that a second side of the media object contacts the first belt and the second belt both the first belt and the second belt at least partially encircles the drum.

17. The method of claim 16, wherein rotating the media object around the drum further comprises causing the media object to be held in between the tape, the first belt, and the second belt.

18. The method of claim 16, wherein rotating the media object around the drum further comprises causing the first side of the media object to contact a first side of the tape and second side of the media object to contact a second side of the tape.

19. The method of claim 16, further comprising removing the media object from the drum.

20. The method of claim 16, further comprising adjusting a tension on the first belt and a tension on the second belt.

* * * * *